US005989101A

United States Patent [19]

Jenn-Shyang et al.

[11] Patent Number: 5,989,101

[45] Date of Patent: Nov. 23, 1999

[54] BRA HAVING CELL RECEIVED THEREIN

[76] Inventors: Tsai Jenn-Shyang, No. 25-2, Ching Yun Alley, Dong Jinn Road, Sha Luh Town, Taichung Hsien, Taiwan; Yu Yuh-Lan, 2F, No. 361, Syh Wei Road, Buan Chyau City, Taipei Hsien, Taiwan

[21] Appl. No.: 09/150,238

[22] Filed: Sep. 10, 1998

[51] Int. Cl.[6] ..... A41C 3/10

[52] U.S. Cl. ..... 450/57; 450/38; 239/36

[58] Field of Search ..... 2/1, 83, 46, 48, 2/49.1, 80, 247, 75, 248, 104, 249, 105, 250, 106, 251, 113, 114, 152, 252, 253, 73, 405, 69, 400–409; 450/53, 54, 55, 56, 57, 30–32, 38, 89; D23/366, 367, 351, 355; 239/36, 152, 153, 653; 512/1, 4

[56] References Cited

U.S. PATENT DOCUMENTS

| | | | |
|---|---|---|---|
| 4,024,876 | 5/1977 | Penrock | 450/48 |
| 4,744,514 | 5/1988 | Gadoua | 239/36 |
| 5,098,330 | 3/1992 | Greenberg | 450/55 |
| 5,678,251 | 10/1997 | Getz | 2/406 |
| 5,782,671 | 7/1998 | Suen et al. | 450/38 |
| 5,823,432 | 10/1998 | Hogan | 239/36 |
| 5,823,852 | 10/1998 | Chu | 450/38 |
| 5,899,790 | 5/1999 | Berg | 450/1 |

*Primary Examiner*—Gloria M. Hale
*Attorney, Agent, or Firm*—Rosenberg, Klein & Lee

[57] ABSTRACT

A bra includes two brassiere cups and two side straps extending from the two brassiere cups each of which has a perfume cell attached to the inner side thereof with a lining member attached to the inner side of the brassiere cup to position the perfume cell. Each of the perfume cell has a mixture liquid received therein and an inlet defined therein so that the perfume will be dispensed by the body temperature.

7 Claims, 4 Drawing Sheets

BRA HAVING CELL RECEIVED THEREIN

FIELD OF THE INVENTION

The present invention relates to a bra, and more particularly, to a bra having two perfume cells received in the two brassiere cups

BACKGROUND OF THE INVENTION

Conventional bras generally comprise two brassiere cups with side straps having back-hook closure or front-hook closure to securely wear the bra to the body. Two shoulder straps are connected between each pair of brassiere cup and the side strap so that the bra is well worn to the body. It is troublesome if the weather is hot and wet, the bra contacting the body will cause sticky and uncomfortable feeling. Under some conditions, smell is not good because of sweat.

The present invention intends to provide a bra having a perfume cell received in each of the two brassiere cups so that the body temperature will dispense the perfume. Furthermore, the perfume cells are shaped to perform as falsies.

SUMMARY OF THE INVENTION

In accordance with one aspect of the present invention, there is provided a bra comprising two brassiere cups with two side straps respectively extending from the two brassiere cups, two perfume cells respectively attached to the inner side of the two brassiere cups. Two lining members are attached to the two brassiere cups to position the perfume cells between the brassiere cups and the two lining members.

An object of the present invention is to provide a bra having perfume dispensed therefrom.

Another object of the present invention is to provide a bra having perfume cells attached thereto.

Yet another object of the present invention is to provide a bra having magnets disposed thereto.

Further objects, advantages, and features of the present invention will become apparent from the following detailed description with appropriate reference to the accompanying drawings.

DETAILED DESCRIPTION OF THE PREFERRED EMBODIMENTS

Figure 1:
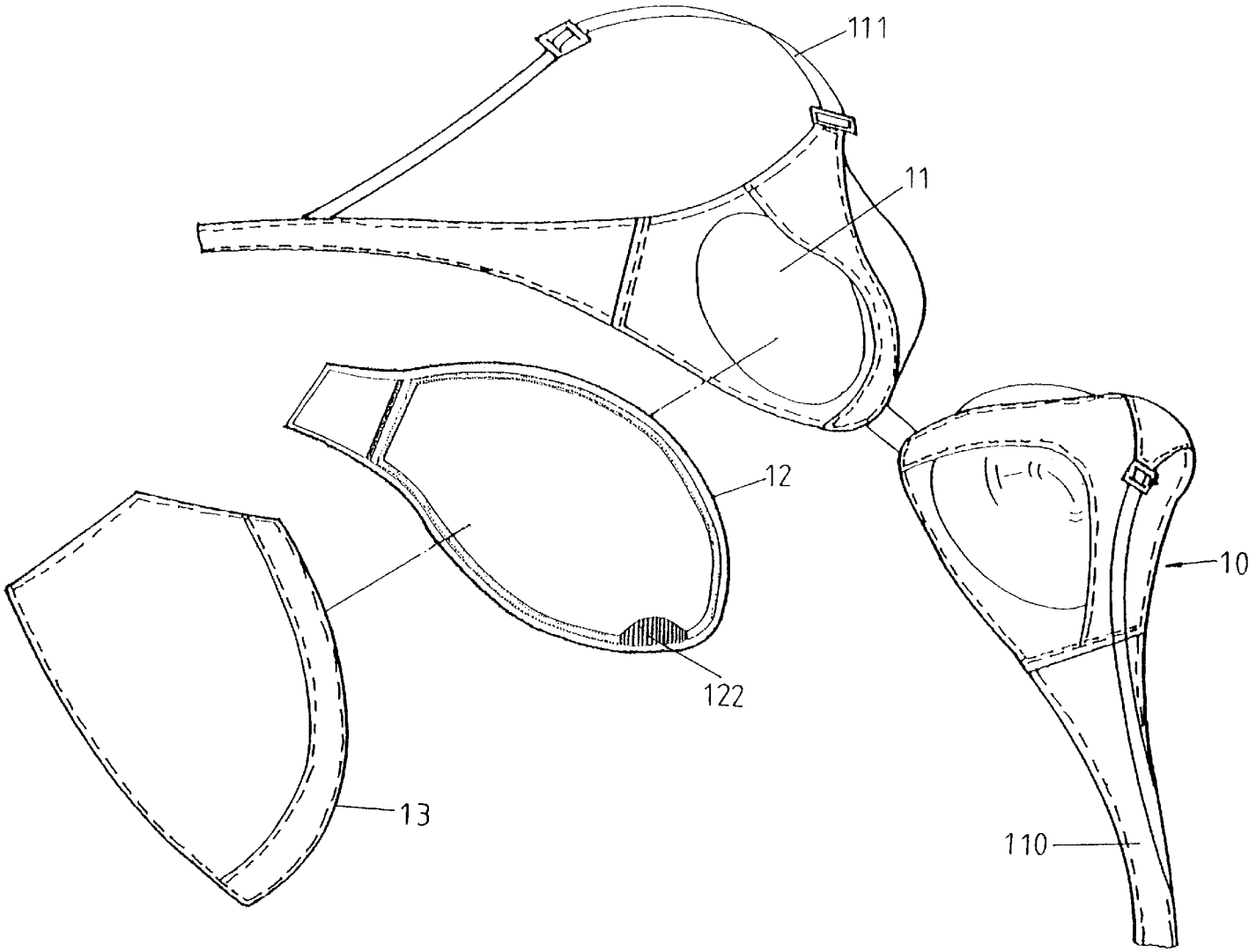
FIG. 1 is an exploded view of the bra in accordance with the present invention.
Figure 2:
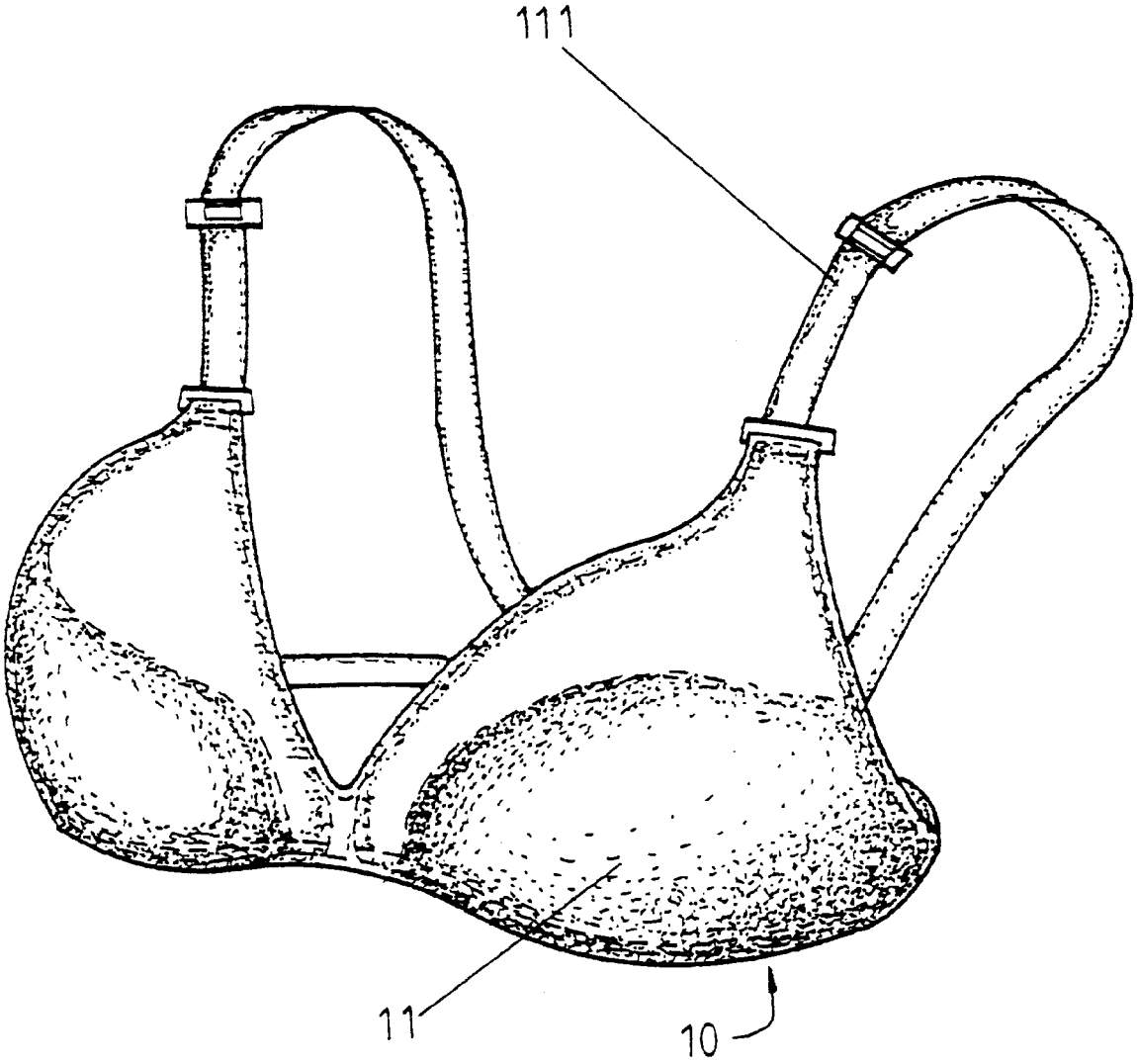
FIG. 2 is a perspective view of the bra in accordance with the present invention.

Referring to FIGS. 1 and 2, the bra 10 in accordance with the present invention comprises two brassiere cups 11 with two side straps 110 respectively extending from the two brassiere cups 11 and two shoulder straps 111 respectively connected between corresponding pair of the side strap 110 and the brassiere cup 11. Two perfume cells 12 are respectively attached to the inner side of the two brassiere cups 11, two lining members 13 attached to the two brassiere cups 11 to position the perfume cells 12 between the brassiere cups 11 and the two lining members 13.

Each of the perfume cells 12 is a soft and flexible cell and has a mixture liquid received therein which includes 50% of oil, 35% of perfume and 20% of volatile agent. An inlet 122 is defined in each of the perfume cells 12 so as to add or release the mixture liquid in the cell 12.

Figure 3:
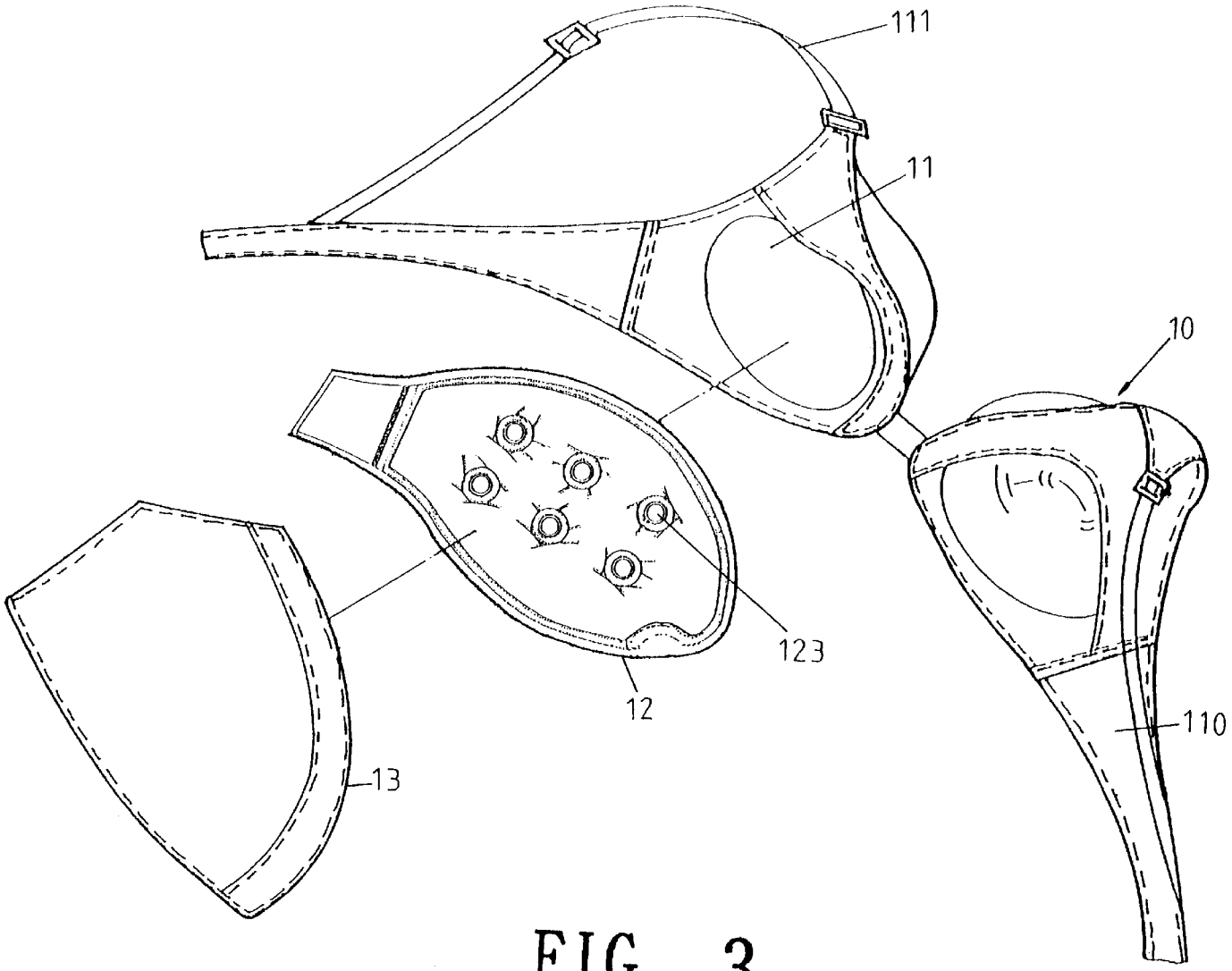
FIG. 3 is an exploded view of a first embodiment of the bra in accordance with the present invention.

Referring to FIG. 3 shown another embodiment of the bra 10 of the present invention wherein a plurality of magnets 131 are attached to each of the lining members 13 so as to enhance the blood circulation of the breasts.

Figure 4:
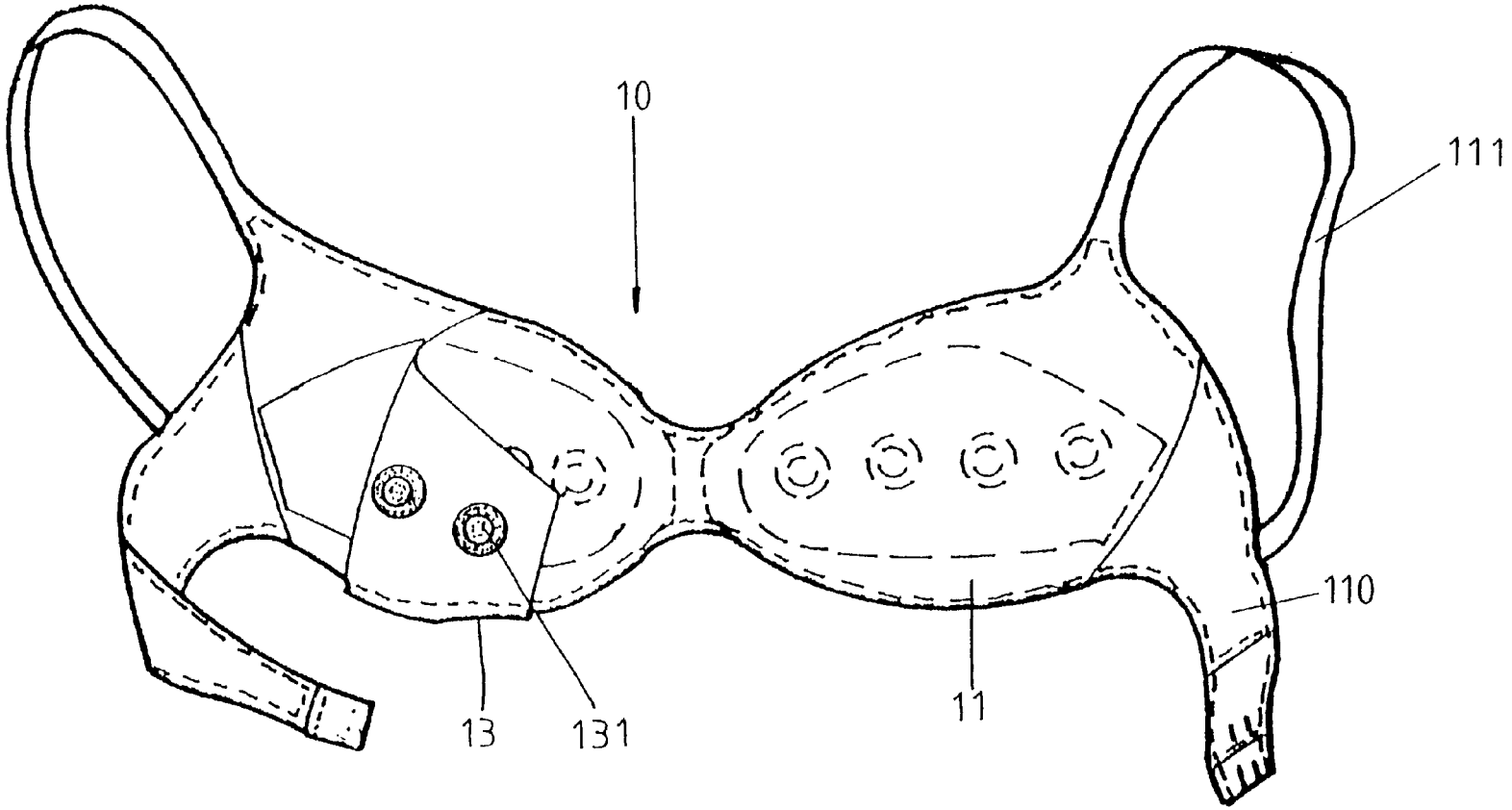
FIG. 4 is a perspective view of a second embodiment of the bra in accordance with the present invention.

FIG. 4 shows yet another embodiment of the bra 10 of the present invention, wherein a plurality of air permeable orifice 123 are defined in each of the perfume cells 12 so as to provide good air circulation in the contacting areas.

The invention is not limited to the above embodiment but various modification thereof may be made. It will be understood by those skilled in the art that various changes in form and detail may made without departing from the scope and spirit of the present invention.

What is claimed is:

1. A bra comprises two brassiere cups with two side straps respectively extending from said two brassiere cups, two perfume cells respectively attached to the inner side of said two brassiere cups, two lining members attached to said two brassiere cups to position said perfume cells between said brassiere cups and said two lining members.

2. The bra as claimed in claim 1, wherein each of said perfume cells has a liquid mixture received therein.

3. The bra as claimed in claim 2, wherein said liquid mixture includes 50% of oil, 35% of perfume and 20% of volatile agent.

4. The bra as claimed in claim 1 further comprising an inlet defined in each of said perfume cells.

5. The bra as claimed in claim 1 further comprising at least one magnet attached to each of said lining members.

6. The bra as claimed in claim 1 further comprising at least one permeable orifice defined in each of said perfume cells.

7. The bra as claimed in claim 1 further comprising two shoulder straps respectively connected between corresponding pairs of said side strap and said brassiere cup.

* * * * *